US008556399B2

(12) United States Patent
Amesbury et al.

(10) Patent No.: US 8,556,399 B2
(45) Date of Patent: Oct. 15, 2013

(54) FLUID INTERCONNECT FOR FLUID EJECTION SYSTEM

(75) Inventors: Marjan S. Amesbury, Albany, OR (US); Mark A. Smith, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 136 days.

(21) Appl. No.: 13/126,899

(22) PCT Filed: Oct. 30, 2008

(86) PCT No.: PCT/US2008/081784

§ 371 (c)(1), (2), (4) Date: Apr. 29, 2011

(87) PCT Pub. No.: WO2010/050954

PCT Pub. Date: May 6, 2010

(65) Prior Publication Data

US 2011/0228022 A1 Sep. 22, 2011

(51) Int. Cl.
*B41J 2/175* (2006.01)

(52) U.S. Cl.
USPC ..... 347/93; 347/85; 347/23

(58) Field of Classification Search
USPC ..... 347/23, 85–93
See application file for complete search history.

(56) References Cited

U.S. PATENT DOCUMENTS

| | | | | |
|---|---|---|---|---|
| 5,081,472 | A | 1/1992 | Fisher | |
| 5,502,479 | A * | 3/1996 | Ishinaga et al. | 347/93 |
| 5,900,898 | A | 5/1999 | Shimizu et al. | |
| 5,949,458 | A | 9/1999 | Studholme | |
| 6,082,852 | A * | 7/2000 | Soga et al. | 347/86 |
| 6,199,979 | B1 | 3/2001 | Hobson et al. | |
| 6,361,146 | B1 | 3/2002 | Saldanha Singh et al. | |
| 6,572,214 | B2 | 6/2003 | Otis, Jr. et al. | |
| 6,592,215 | B2 * | 7/2003 | Udagawa et al. | 347/93 |
| 6,749,295 | B2 * | 6/2004 | Kim et al. | 347/87 |
| 6,969,164 | B2 | 11/2005 | Kerr et al. | |
| 6,986,571 | B2 | 1/2006 | Dudenhoefer et al. | |
| 7,055,942 | B2 * | 6/2006 | Amma et al. | 347/93 |
| 7,070,267 | B2 * | 7/2006 | Yamaguchi et al. | 347/93 |
| 7,188,942 | B2 | 3/2007 | Haines et al. | |
| 7,192,129 | B2 | 3/2007 | Droege et al. | |
| 7,290,871 | B2 | 11/2007 | Greer et al. | |
| 2004/0257414 | A1 | 12/2004 | Anderson, Jr. et al. | |
| 2006/0227182 | A1 | 10/2006 | Greer et al. | |

FOREIGN PATENT DOCUMENTS

| | | | |
|---|---|---|---|
| EP | 0574888 | A2 | 12/1993 |
| JP | 09299708 | | 11/1997 |
| JP | 10024009 | | 1/1998 |
| JP | 2007307851 | A | 11/2007 |

OTHER PUBLICATIONS

PCT Search Report and Written Opinion mailed Jun. 30, 2009 (11 pgs.).
Extended European Search Report mailed Oct. 17, 2011, 7 pgs.

* cited by examiner

*Primary Examiner* — Ellen Kim

(57) ABSTRACT

A fluid interconnect for a fluid ejection system includes a fluid port having a fluid passage formed therethrough, and a filter provided at an end of the fluid port such that fluid passing through the fluid port passes through the filter to the fluid passage, wherein the filter is secured to an end surface and a peripheral surface of the fluid port.

17 Claims, 7 Drawing Sheets

FLUID INTERCONNECT FOR FLUID EJECTION SYSTEM

BACKGROUND

Inkjet printers typically utilize a printhead that includes an array of orifices (also called nozzles) through which ink is ejected on to paper or other print media. One or more printheads may be mounted on a movable carriage that traverses back and forth across the width of the paper feeding through the printer, or the printhead(s) may remain stationary during printing operations, as in a page width array of printheads. A printhead may be an integral part of an ink cartridge or part of a discrete assembly to which ink is supplied from a separate, often detachable ink container. For printhead assemblies that utilize detachable ink containers, the operative fluid connection between the outlet of the ink container and the inlet to the printhead assembly is commonly provided through a fluid interconnect.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Embodiments of the disclosure were developed in an effort to improve the fluid interconnection between a printhead assembly and a detachable/replaceable ink container—to construct a fluid interconnection providing a robust, reliable filter ink flow interface throughout repeated installations and removals of the ink container. Embodiments will be described, therefore, with reference to an inkjet printhead assembly that holds detachable/replaceable ink containers. Embodiments of the disclosure, however, are not limited to such implementations. Embodiments of the disclosure, for example, might also be implemented in other types of ink or fluid dispensing components. The example embodiments shown in the Figures and described below, therefore, illustrate but do not limit the scope of the disclosure.

Figure 1:
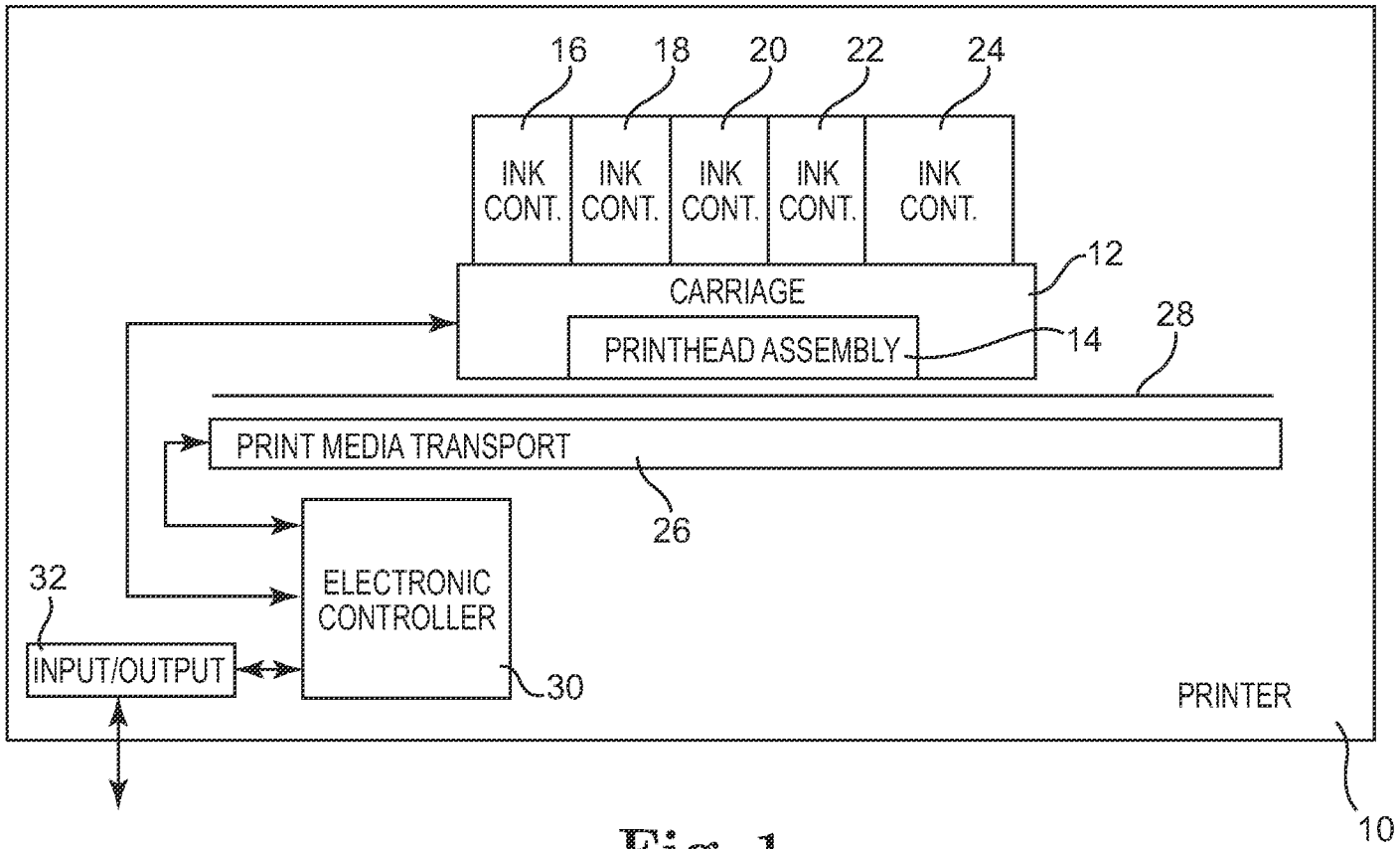
FIG. 1 is a block diagram illustrating one embodiment of an inkjet printer.

FIG. 1 is a block diagram illustrating an inkjet printer 10 in which embodiments of the disclosure may be implemented. Referring to FIG. 1, printer 10, as an embodiment of a fluid ejection system, includes a carriage 12 carrying a printhead assembly 14 and detachable ink containers 16, 18, 20, 22, and 24. Inkjet printer 10 and printhead assembly 14 represent more generally a fluid-jet precision dispensing device and fluid ejector assembly for precisely dispensing a fluid, such as ink, as described in more detail below. Printhead assembly 14 includes a printhead (not shown) through which ink from one or more containers 16-24 is ejected. For example, printhead assembly 14 may include two printheads—one for a series of color containers 16-22 and one for a black ink container 24. An inkjet printhead is typically a small electromechanical assembly that contains an array of miniature thermal, piezoelectric or other devices that are energized or activated to eject small droplets of ink out of an associated array of orifices. A typical thermal inkjet printhead, for example, includes a orifice plate arrayed with ink ejection orifices and firing resistors formed on an integrated circuit chip.

A print media transport mechanism 26 advances print media 28 past carriage 12 and printhead assembly 14. For a stationary carriage 12, media transport 26 may advance media 28 continuously past carriage 12. For a movable, scanning carriage 12, media transport 26 may advance media 28 incrementally past carriage 12, stopping as each swath is printed and then advancing media 28 for printing the next swath.

An electronic controller 30 is operatively connected to a moveable, scanning carriage 12, printhead assembly 14 and media transport 26. Controller 30 communicates with external devices through an input/output device 32, including receiving print data for inkjet imaging. The presence of an input/output device 32, however, does not preclude the operation of printer 10 as a stand alone unit. Controller 30 controls the movement of carriage 12 and media transport 26. Controller 30 is electrically connected to each printhead in printhead assembly 14 to selectively energize the firing resistors, for example, to eject ink drops on to media 28. By coordinating the relative position of carriage 12 with media 28 and the ejection of ink drops, controller 30 produces the desired image on media 28.

While this Description is at least substantially presented herein to inkjet-printing devices that eject ink onto media, those of ordinary skill within the art can appreciate that embodiments of the present disclosure are more generally not so limited. In general, embodiments of the present disclosure pertain to any type of fluid-jet precision dispensing device or ejector assembly for dispensing a substantially liquid fluid. The fluid-jet precision dispensing device precisely prints or dispenses a substantially liquid fluid in that the latter is not substantially or primarily composed of gases such as air. Examples of such substantially liquid fluids include inks in the case of inkjet printing devices. Other examples of substantially liquid fluids include drugs, cellular products, organisms, chemicals, fuel, and so on, which are not substantially or primarily composed of gases such as air and other types of gases. Therefore, while the Description is described in relation to an inkjet printer and inkjet printhead assembly for ejecting ink onto media, embodiments of the present disclosure more generally pertain to any type of fluid-jet precision dispensing device or fluid ejector structure for dispensing a substantially liquid fluid.

Figure 2:
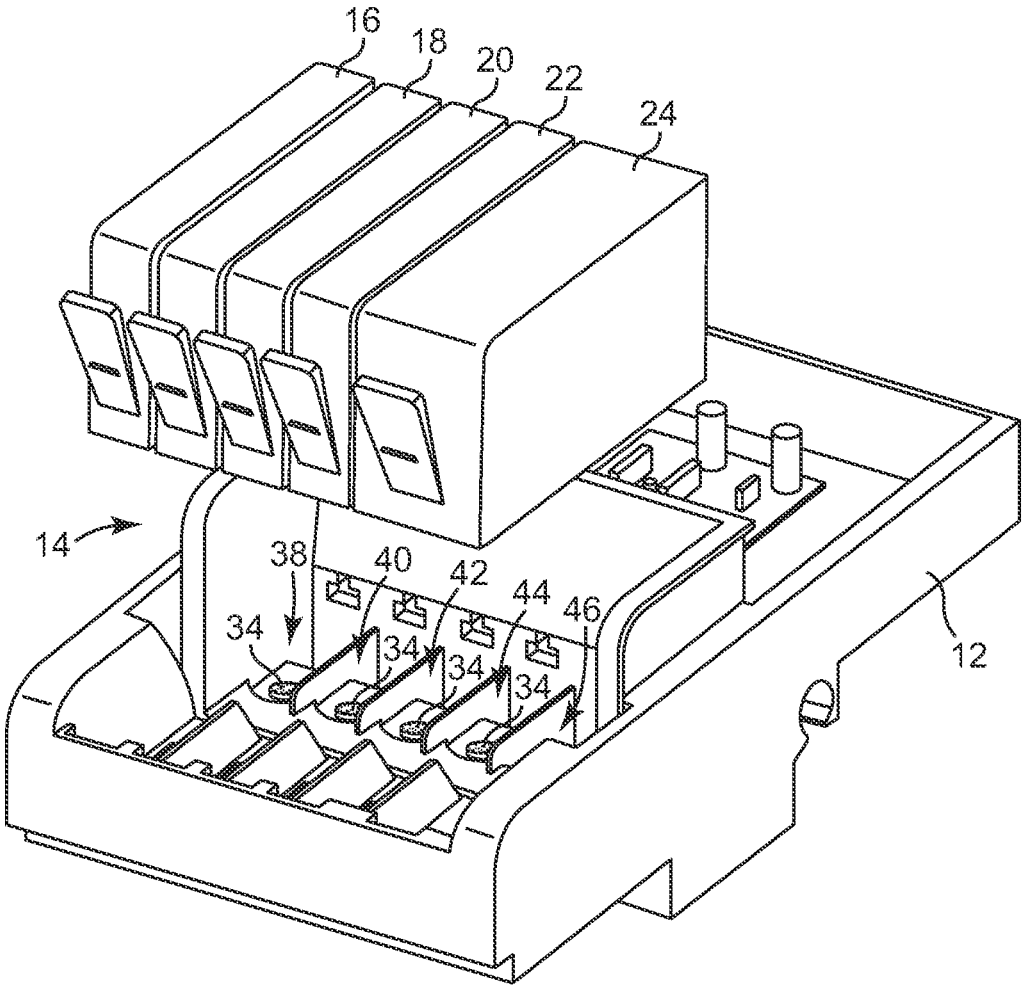
FIGS. 2 and 3 are perspective views illustrating one embodiment of a carriage and printhead assembly, as may be used in the printer of FIG. 1, with the ink containers exploded from the carriage to show ink inlets to the printhead assembly (FIG. 2) and ink outlets from the ink containers (FIG. 3).
Figure 3:
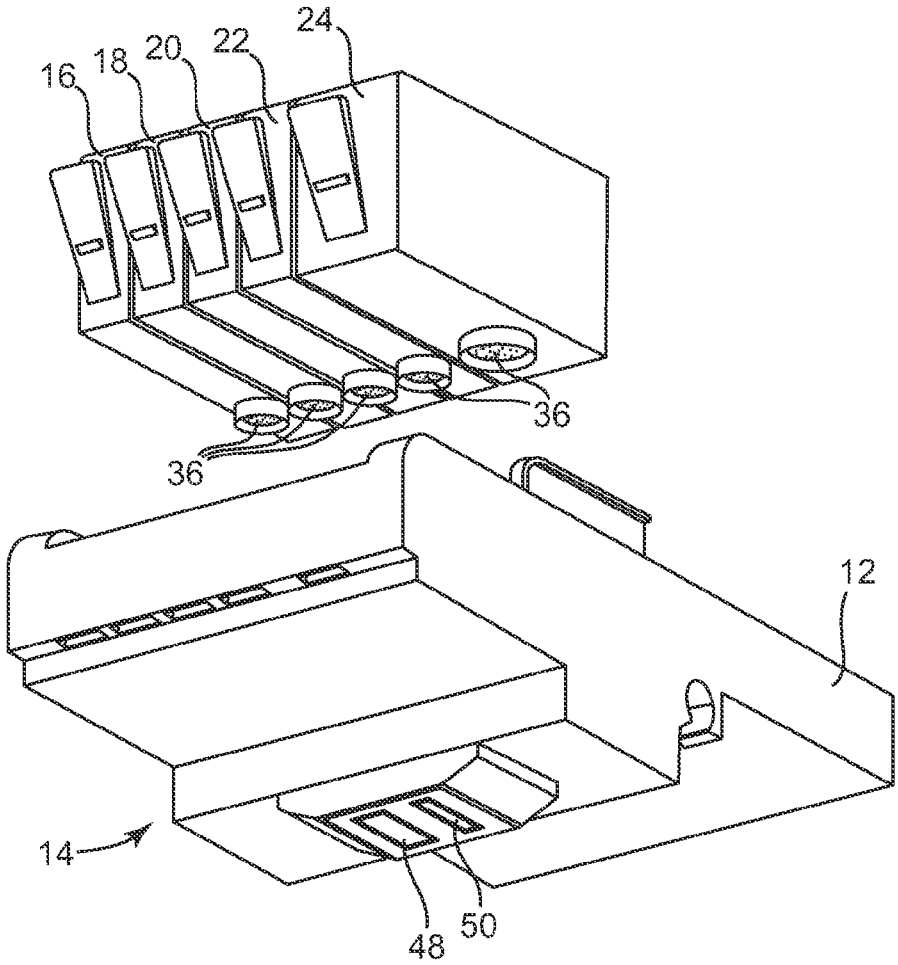

FIGS. 2 and 3 are perspective views of one embodiment of a carriage 12 and printhead assembly 14 in printer 10. Ink containers 16-24 are exploded out from carriage 12 to show ink inlets 34 to printhead assembly 14 (FIG. 2) and ink outlets 36 from ink containers 16-24 (FIG. 3). Referring to FIG. 2, printhead assembly 14 includes an ink inlet 34, as an embodiment of a fluid port, positioned at each bay 38, 40, 42, 44, and 46 for a corresponding ink container 16-24. Printhead assembly 14 and carriage 12 may be integrated together as a single part or printhead assembly 14 may be detachable from carriage 12. For a detachable printhead assembly 14, container bays 38-46 may extend out into carriage 12 as necessary or desirable to properly receive and hold containers 16-24.

Referring to FIG. 3, in the embodiment shown, printhead assembly 14 includes two printheads 48 and 50. Ink from color ink containers 16-22, for example, is ejected from printhead 48 and ink from a black container 24 is ejected from printhead 50. Each ink container 16-24 includes an ink outlet 36, as an embodiment of a fluid port, through which ink may flow from container 16-24 through the corresponding ink inlet 34 (FIG. 2) to a corresponding printhead 48 or 50 in printhead assembly 14.

Figure 4:
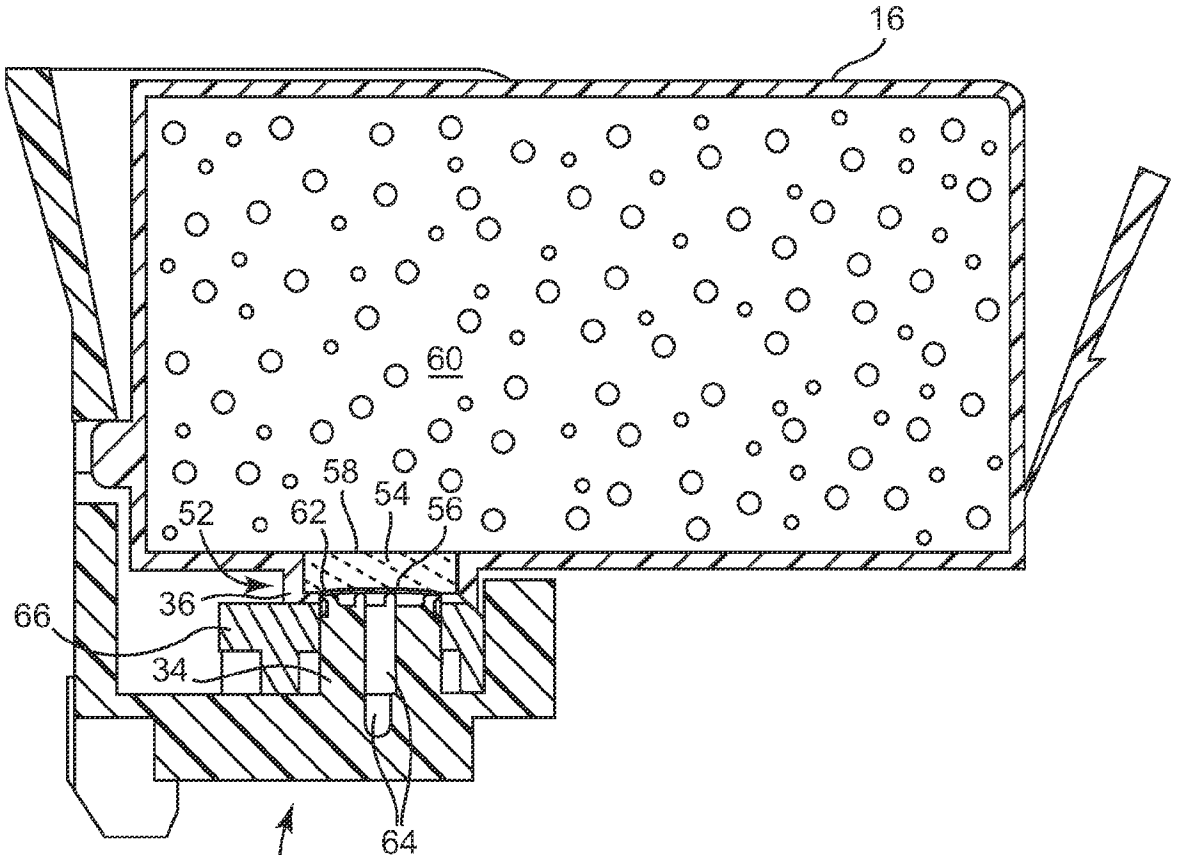
FIG. 4 is a section view illustrating one embodiment of a fluid interconnect between an ink container and the printhead assembly.

FIG. 4 is an elevation section view showing one embodiment of a fluid interconnect 52 between an ink container 16 and printhead assembly 14. Referring to FIG. 4, fluid interconnect 52 includes a wick 54 in container outlet 36 and a filter 56 at printhead assembly inlet 34. In one embodiment, an upstream surface 58 of outlet wick 54 contacts foam or other ink holding material 60 in ink container 16. In another embodiment, where ink container 16 holds so called "free ink", and there is no ink holding material, upstream surface 58 of outlet wick 54 is exposed to the free ink in ink container 16. As shown in the embodiment of FIG. 4, a downstream surface 62 of outlet wick 54 is in contact with filter 56 when container 16 is installed in printhead assembly 14.

An ink channel 64, as an embodiment of a fluid passage, is provided in inlet 34 downstream from filter 56 and carries ink to printhead 48 (FIG. 3). Inlet 34 is sometimes referred to as an inlet "tower" because it usually extends out from the surrounding structure. In one embodiment, container outlet 36 fits around inlet 34 and seals against an elastomeric gasket or other suitable seal 66 to help prevent vapor loss from fluid interconnect 52.

Figure 5:
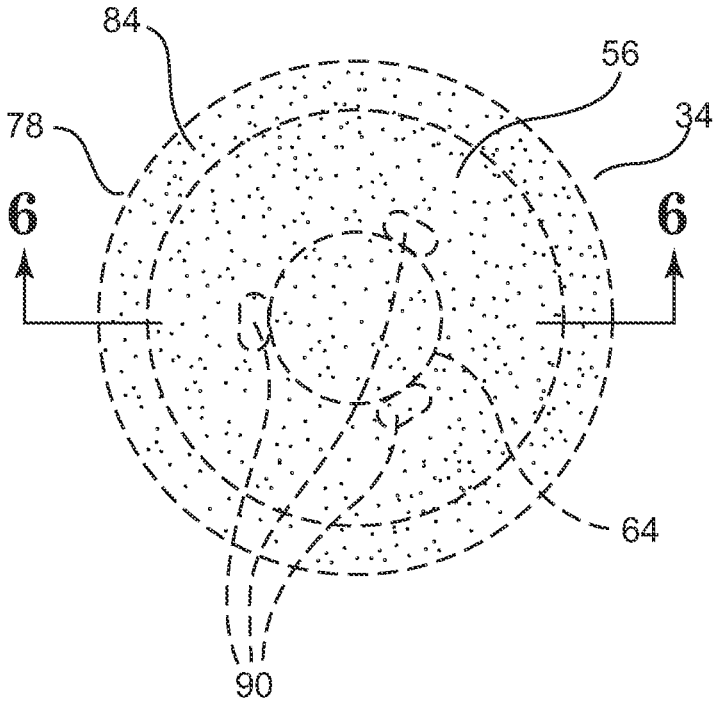
FIGS. 5 and 6 are plan and section views, respectively, illustrating one embodiment of a filter on an ink inlet for the printhead assembly.
Figure 6:
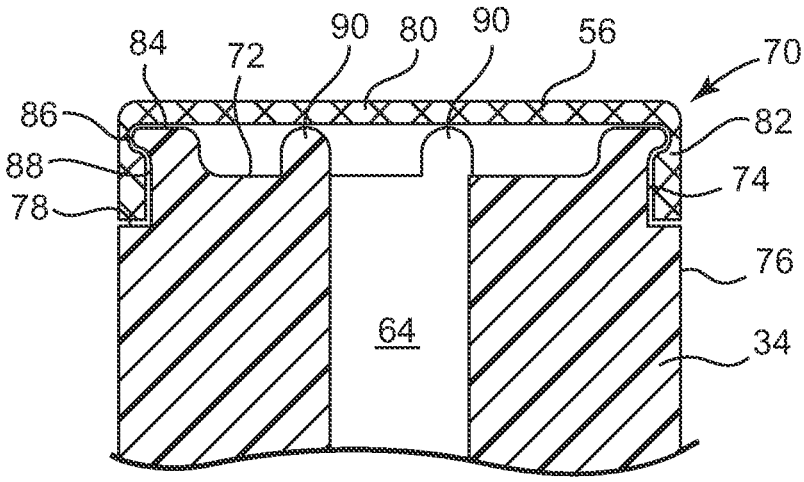

FIGS. 5 and 6 are plan and section views, respectively, illustrating filter 56 on inlet 34. (For clarity, filter 56 in the plan view of FIG. 5 is depicted with stippling and the underlying structure of inlet 34 is shown with dashed lines.) As illustrated in the embodiment of FIGS. 5 and 6, filter 56 is provided at an end 70 of inlet 34. Ink channel 64, as an embodiment of a fluid passage, communicates with end 70 such that ink (or fluid) passing through inlet 34 passes through filter 56 to ink channel 64. More specifically, in the illustrated embodiment, ink first passes through filter 56 before entering and passing through ink channel 64. In the illustrated embodiment, ink channel 64 is oriented substantially perpendicular to end 70.

In one embodiment, end 70 of inlet 34 includes an end surface 72 and a peripheral surface 74. Peripheral surface 74 is contiguous with end surface 72, and, in one embodiment, oriented orthogonal to end surface 72. In the embodiment of FIGS. 5 and 6, inlet 34 is a circular inlet, and peripheral surface 74 defines an outer perimeter of inlet 34 at end 70.

As illustrated in the embodiment of FIGS. 5 and 6, and as further described below, filter 56 is secured to end surface 72 and peripheral surface 74 of inlet 34. As such, filter 56 extends over and along a side 76 of inlet 34 at end 70. More specifically, in the illustrated embodiment, filter 56 includes a central portion 80 and a peripheral portion 82 wherein central portion 80 is extended over ink channel 64 and peripheral portion 82 is extended along side 76 of inlet 34. In one embodiment, a step 78 is provided in side 76 of inlet 34 at end 70 to accommodate peripheral portion 82 of filter 56. In one embodiment, peripheral portion 82 of filter 56 is fit within step 78 such that an outer diameter of filter 56 along side 76 of inlet 34 substantially coincides with an outer diameter of inlet 34 at end 70 thereby providing a smooth transition between filter 56 and side 76 of inlet 34 at end 70.

In one embodiment, as illustrated in FIGS. 5 and 6, end surface 72 of inlet 34 includes a rim 84, and peripheral surface 74 of inlet 34 includes a lip 86 and a recessed portion 88. In one embodiment, rim 84 is provided along a perimeter of end surface 72. In addition, lip 86 extends from rim 84 and recessed portion 88 is formed below lip 86. As such, filter 56 is secured to end surface 72 of inlet 34 along rim 84, and extends over lip 86 and is secured to peripheral surface 74 of inlet 34 within recessed portion 88. In one embodiment, lip 86 is formed during the process of "staking" or securing filter 56 to inlet 34, as described below.

In one embodiment, as illustrated in FIGS. 5 and 6, one or more protrusions 90 are provided at end 70 of inlet 34. In one embodiment, protrusions 90 extend from end surface 72 and support central portion 80 of filter 56 over ink channel 64. Protrusions 90 may include any number of protrusions, and may be of various sizes and shapes and may be arranged in various configurations, arrays or spacings.

Figure 7:
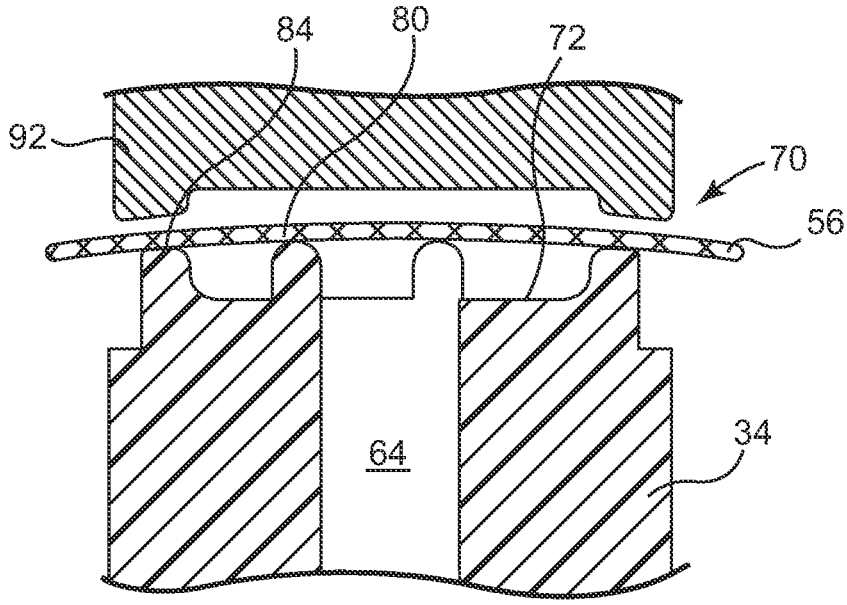
FIGS. 7-10 are section views illustrating one embodiment of a method of securing the filter to the ink inlet.
Figure 8:
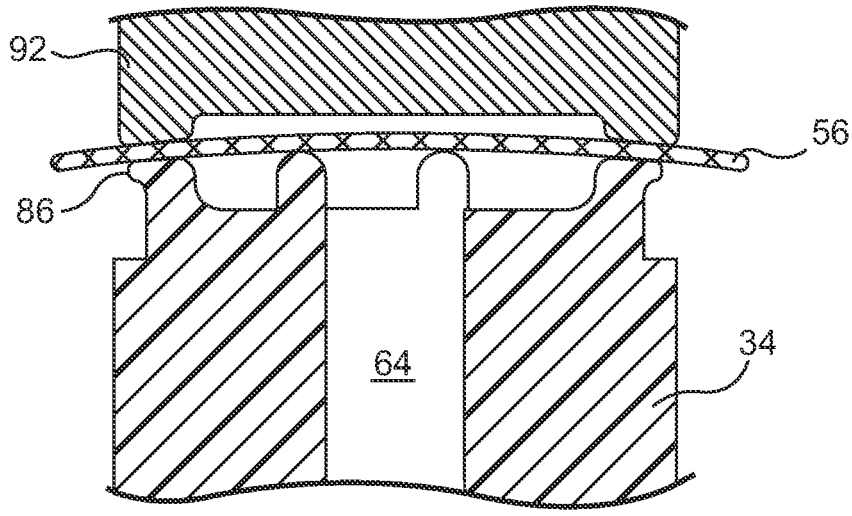

FIGS. 7-10 are section views illustrating one embodiment of a method of securing filter 56 to inlet 34. In a first operation, as illustrated in FIGS. 7 and 8, filter 56 is placed over end 70 of inlet 34 so as to cover an opening of ink channel 64 as communicated with end 70. Thereafter, in one embodiment, a staking tool 92 is used to "stake" and secure filter 56 to end 70 of inlet 34. More specifically, staking tool 92 is used to secure central portion 80 of filter 56 to rim 84 of end surface 72.

Staking tool 92 is shown slightly spaced from filter 56 in FIG. 7, and in contact with filter 56 in FIG. 8. Staking tool 92 may include, for example, a heated die or ultrasonic welding horn which contacts and presses filter 56 against inlet 34. As such, staking tool 92 softens or melts the material (e.g., plastic) of inlet 34 at rim 84 and presses filter 56 into the softened or melted material thereby "staking" and securing filter 56 to inlet 34.

In one embodiment, as illustrated in FIG. 8, lip 86 is formed along peripheral surface 74 during the process of "staking" filter 56 to inlet 34. For example, lip 86 is formed by softened or melted material of rim 84 moving radially outward as staking tool 92 presses filter 56 against rim 84 of inlet 34.

Figure 9:
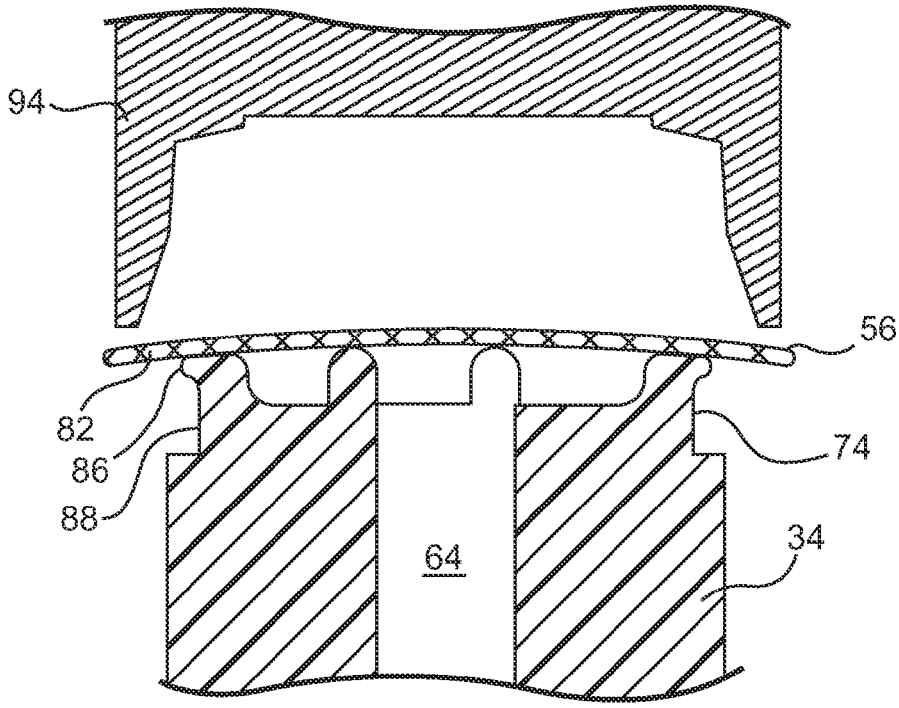
Figure 10:
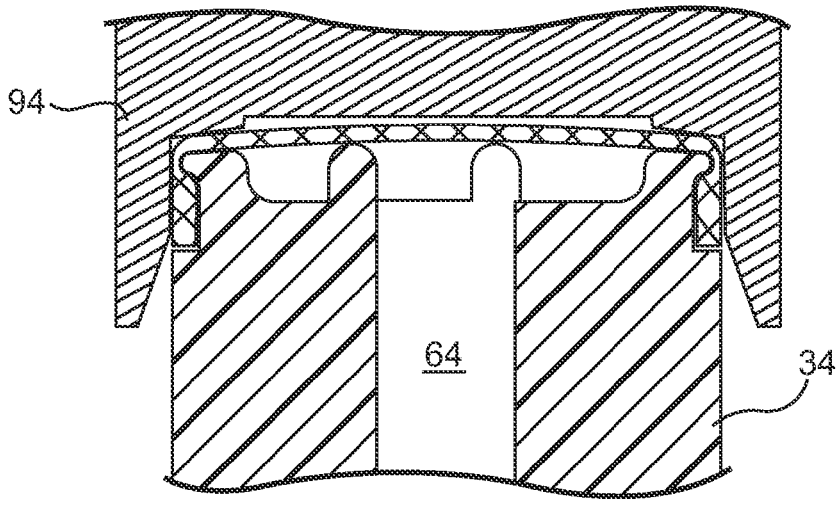

In a second operation, as illustrated in FIGS. 9 and 10, a wrapping tool 94 is used to "wrap" and secure filter 56 around end 70 of inlet 34. More specifically, wrapping tool 94 is used to secure peripheral portion 82 of filter 56 to peripheral surface 74 of inlet 34. Wrapping tool 94 is shown slightly spaced from filter 56 in FIG. 9, and surrounding or encapsulating filter 56 in FIG. 10. In one embodiment, as wrapping tool 94 captures and surrounds filter 56, peripheral portion 82 of filter 56 is extended over and wrapped around lip 86, and secured within recessed portion 88 thereby further securing filter 56 to inlet 34.

The above-described filter-attach process, during which, in a first "stake" operation, filter 56 is placed on top of inlet 34 and staked to rim 84, and then, in a second "wrap and stake" operation, the free edge of filter 56 is folded down around inlet 34 and staked to side 76 of inlet 34, helps ensure a seal on top of inlet 34 as well as the side of inlet 34. With the above-described fluid interconnect, the inlet geometry including, for example, the rim height, thickness, and shape can be optimized for the particular filter diameter and thickness used on inlet 34. This helps ensure that the desired filter contact area and adequate attach area are achieved. In addition, providing step 78 in the side of inlet 34 allows room for the wrapped portion of filter 56, thus creating a uniform tower diameter after the filter-attach process is completed.

The above-described fluid interconnect and filter-attach process also help maximize filter contact area for a given inlet diameter thereby resulting in increased flow area, help ease filter bubble pressure requirements as a result of the increased flow area, help reduce filter alignment precision requirements, and help provide a more consistent and uniform filter contact area since there is not an interruption between the completed stake ring and the functional filter area. More specifically, with the above-described fluid interconnect and filter-attach process, placing the filter on top of the inlet rim and staking the filter on top of the inlet rim and on the side of the inlet, instead of within the inlet rim, allows for a larger filter contact or flow area for a given tower diameter. Since area is proportional to the diameter squared, a small increase in effective diameter results in a significant performance improvement (e.g., a 4 mm increase in effective diameter results in a 20 percent increase in the flow area). Accordingly, making optimal use of the given tower size helps maximize fluidic flow area, thereby improving throughput and print quality performance.

Furthermore, since, with the filter-attach process described, the attach area of the filter is large compared to the overall filter surface area, the staking process can be performed at a lower staking temperature. Performing the filter-attach process at a lower staking temperature contributes to a more stable process and more consistent product performance, and helps avoid undesirable filter damage.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid interconnect for a fluid ejection system, comprising:

a fluid port having a fluid passage formed therethrough; and a filter provided at an end of the fluid port such that fluid passing through the fluid port passes through the filter to the fluid passage, wherein the filter is secured to an end surface and a peripheral surface of the fluid port, and includes a central portion extended over the fluid passage and a peripheral portion extended along a side of the fluid port, wherein a step is provided in the side of the fluid port, and the peripheral portion of the filter is fit within the step.

2. The fluid interconnect of claim 1, wherein the peripheral surface of the fluid port is provided along the side of the fluid port.

3. The fluid interconnect of claim 1, wherein the end of the fluid port includes one or more protrusions, wherein the one or more protrusions support the central portion of the filter over the fluid passage.

4. The fluid interconnect of claim 1, wherein the peripheral surface of the fluid port is contiguous with the end surface of the fluid port.

5. The fluid interconnect of claim 1, wherein the end surface of the fluid port includes a rim, wherein the filter is secured to the rim.

6. The fluid interconnect of claim 1, wherein the peripheral surface of the fluid port includes a lip, wherein the filter extends over the lip.

7. The fluid interconnect of claim 1, wherein the peripheral surface of the fluid port includes a recessed portion, wherein the filter is secured within the recessed portion.

8. A fluid ejection system, comprising:

a fluid container containing a supply of a fluid;

a fluid ejection assembly adapted to eject drops of the fluid; and a fluid interconnect for communicating the fluid of the fluid container with the fluid ejection assembly, the fluid interconnect including a fluid port and a filter secured to an end surface and a peripheral surface of the fluid port, wherein a peripheral portion of the filter is secured within a recessed portion of the peripheral surface of the fluid port, wherein the peripheral surface of the fluid port is provided along a side of the fluid port.

9. The fluid ejection system of claim 8, wherein the peripheral surface of the fluid port is contiguous with the end surface of the fluid port.

10. The fluid ejection system of claim 8, wherein a central portion of the filter is extended over a fluid passage of the fluid port and the peripheral portion of the filter is extended over a lip of the peripheral surface and along the side of the fluid port.

11. A method of forming a fluid interconnect for a fluid ejection system, the method comprising:

providing a fluid port having a fluid passage formed therethrough;

extending a filter over the fluid passage;

securing the filter to an end surface of the fluid port; and securing the filter to a peripheral surface of the fluid port, including extending a peripheral portion of the filter along a side of the fluid port, and fitting the peripheral portion within a step provided in the side of the fluid port.

12. The method of claim 11, wherein the peripheral surface of the fluid port is contiguous with the end surface of the fluid port.

13. The method of claim 11, wherein extending the filter over the fluid passage includes extending a central portion of the filter over the fluid passage, wherein securing the filter to the end surface includes forming a lip along the peripheral surface, and wherein securing the filter to the peripheral surface includes extending the peripheral portion of the filter over the lip and along the side of the fluid port.

14. The method of claim 13, wherein extending the central portion of the filter over the fluid passage includes supporting the central portion of the filter with one or more protrusions provided at an end of the fluid port.

15. The method of claim 11, wherein the peripheral surface of the fluid port is provided along the side of the fluid port.

16. The fluid ejection system of claim 8, wherein the peripheral portion of the filter is fit within a step provided in the side of the fluid port.

17. The fluid ejection system of claim 10, wherein an end of the fluid port includes one or more protrusions, wherein the one or more protrusions support the central portion of the filter over the fluid passage.

* * * * *